US005129652A

United States Patent [19]

Wilkinson

[11] Patent Number: 5,129,652

[45] Date of Patent: Jul. 14, 1992

[54] CASINO DRAWING/LOTTERY GAME AND CASE/PRIZE MANAGEMENT SYSTEM

[76] Inventor: William T. Wilkinson, 1717 Town Point Rd., Chesapeake City, Md. 21921

[21] Appl. No.: 650,096

[22] Filed: Feb. 4, 1991

[51] Int. Cl.[5] ..... A63F 3/06

[52] U.S. Cl. ..... 273/139; 283/102; 283/903; 273/138 R

[58] Field of Search ..... 273/239, 138 R, 269; 283/903, 100–103

[56] References Cited

U.S. PATENT DOCUMENTS 5,007,641 4/1991 Seidman ..... 273/138 A

FOREIGN PATENT DOCUMENTS 2085308 4/1982 United Kingdom ..... 283/903

OTHER PUBLICATIONS

Scarne's Complete Guide to Gambling by John Scarne, Simon and Shuster, pp. 432–436, 1961.

*Primary Examiner*—Benjamin Layno

*Attorney, Agent, or Firm*—Connolly & Hutz

[57] ABSTRACT

Gambling activities in a single casino or group of casinos is enhanced by providing players with tickets or cards which qualify the players to special prizes such as from lottery drawings based upon such factors as play time and amount gambled as recorded on the ticket. Elevated tote boards mounted on the ceiling or walls near the ceiling display the periodic drawing, raffle or lottery results.

25 Claims, 9 Drawing Sheets

10

THE BIG HIT $10

CASINO
PURCHASE DATE
PURCHASE TIME
DRAWING #
TICKET #
PLAYER NAME / I.D. #

INSTANT WIN #1 — RUB OFF

INSTANT WIN #2 — RUB OFF

FIG. 1

12

| GAME | CRAPS | BLACKJACK | SLOTS | ROULETTE | BACARAT |
|---|---|---|---|---|---|
| PLAY TIME | | | | | |
| BET SIZE | | | | | |

FIG. 2

THE BIG HIT $10

CASINO
PURCHASE DATE
PURCHASE TIME
DRAWING #
TICKET #
PLAYER NAME / I.D. #

INSTANT WIN #1 — RUB OFF

INSTANT WIN #2 — RUB OFF

FIG. 3 12

TIME

| HRS | MIN | SEC |
|---|---|---|
| 08 | 36 | 35 |

PRIZE
DEADLINE: 9:00

| WIN NUMBERS | | WINNER/ID # | AMOUNT/PRIZE |
|---|---|---|---|
| 46413 | | J. JOHNS | $6.000 |
| 21742 | | D. TRUMP | CADILLAC |
| 31466 | | G. BUSH | VACATION |
| 91999 | | GLASGOW | $14,000 |

FIG. 4 14

THE BIG HIT $10

TICKET #
DRAWING #
PURCHASE DATE
PURCHASE TIME
PLAYER NAME/#

INSTANT WIN #1 — RUB OFF

INSTANT WIN #2 — RUB OFF

16

FIG.7

| THE BIG HIT | CASINO A | CASINO B | CASINO C |
|---|---|---|---|
| CLOCK IN TIME | | | |
| CLOCK OUT TIME | | | |

16

FIG.8

18

TIME

| HRS | MIN | SEC |
|---|---|---|
| 08 | 36 | 35 |

PRIZE DEADLINE:

| | | |
|---|---|---|
| 09 | 00 | 00 |

CASINO A

| WIN NUMBER | WINNER/ID # | AMOUNT/PRIZE |
|---|---|---|
| 21742 | J. JOHNS | CADILLAC |
| 31466 | D. TRUMP | VACATION |
| 91999 | G. BUSH | $14,000 |

CASINO B

| WIN NUMBER | WINNER/ID # | AMOUNT/PRIZE |
|---|---|---|
| 37711 | A. LOSER | $5.00 |
| 44224 | J. LENO | FREE BUFFET |
| 69399 | S. WYNN | MERCEDES |

FIG.9

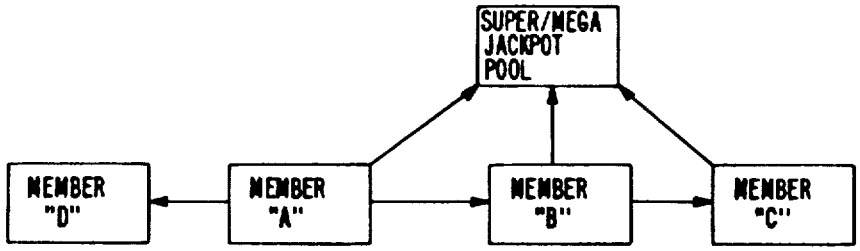

| | | | |
|---|---|---|---|
| **PLAYER INCENTIVE (+)** | | | |
| PLAYER TIME (EXCEEDING MINIMUM) | BONUS POINTS | BONUS POINTS | BONUS POINTS |
| MEMBER PLAY | JACKPOT | A,B SUPER JACKPOT | A,B,C SUPER JACKPOT MEGA JACKPOT |
| **PLAYER PENALTY (-)** | | | |
| TRANSITION TIME (EXCEEDING MAXIMUM) | | NO BONUS POINTS NO A SUPER JACKPOT NO B SUPER JACKPOT | NO BONUS POINTS NO A,B,C SUPER JACKPOT NO MEGA JACKPOT |
| NON MEMBER PLAY | NO BONUS POINTS *NO A JACKPOT NO SUPER JACKPOT | | |

*IF PLAYER IS NOT CLOCKED IN TO A MEMBER CASINO WHEN CASINO A WINNING JACKPOT * IS DRAWN, HE DOES NOT QUALIFY FOR WIN.

FIG. 12

| 46531 | THE BIG HIT | | | 1:15 |
|---|---|---|---|---|
| | | | | |
| 41 | 116 | 18 | 32 | 17 |
| 416 | 5 | 941 | 3 | 99 |
| 105 | 361 | 777 | 121 | 605 |
| 551 | 300 | 212 | 191 | 33 |

| 46531 | THE BIG HIT | 1:15 |
|---|---|---|

NAME: _____

ADDRESS: _____

PHONE #: _____

FIG.13

| 33063 | THE BIG HIT | | 1:18 |
|---|---|---|---|
| TIME PERIOD | # | TIME PERIOD | # |
| 1 | 17 | 5 | 18 |
| 2 | 364 | 6 | 221 |
| 3 | 13 | 7 | 4 |
| 4 | 5 | 8 | 103 |

| 33063 | THE BIG HIT | 1:18 |
|---|---|---|

NAME: _____

ADDRESS: _____

PHONE # _____

FIG. 14

CASINO DRAWING/LOTTERY GAME AND CASE/PRIZE MANAGEMENT SYSTEM

BACKGROUND OF INVENTION

Current competition among casinos is intense. Intercity competition is evident in the rivalry between Las Vegas and Atlantic City. Intra city competition is particularly keen in Atlantic City where the market has exceeded a saturation point, and growth is stagnating.

There is then a need for the casino gaming industry to devise methods and games to compete more effectively against each other, both on an inter and intra city basis.

SUMMARY OF INVENTION

The subject invention generates greater gaming revenues by creating a unique game, for one or more casinos. The system creates powerful attraction and incentives for players to gamble at a particular casino or group of casinos. The system is specifically designed to maximize gaming revenues by optimizing basic revenue generating factors such as:

1. Attendance—Attract large numbers of players.
2. Repeat Business—Increase repeat player attendance.
3. Play Time—Increase the period of time players play.
4. Bet Size—Increase the average amount bet.
5. Gaming Mix—Influence which kind of games players play.

In its broadest aspect the invention involves a method of playing games which could be used for any business where there is a desire to attract and hold large numbers of customers. The invention could thus be used at hotels, airlines, fast food and retail chains.

The invention is particularly adaptable to be used to boost the revenue of gambling establishments, such as horse race tracks, Bingo Parlors, OTB Parlors, Dog Tracks, Jai Alai, Frontons, Sports Betting Parlors, etc.

The invention in its preferred forms may be practiced in two basic forms, intra or intercasino:

1. The intracasino game is run for just one casino, in one city/location.
2. The intercasino game is run for more than one casino (i.e. a group), in one city/location.

In addition to these two basic forms, there are two other possible forms.

3. The game can be run for one casino, in each of a number of locations.
4. The game can be run for more than one casino, in each of a number of locations.

The drawing game attracts and holds players to a casino(s) by mixing certain key inducement/penalty features:

For the intracasino game the features are:

1. A lottery or keno/bingo type drawing and prizes.
2. "Instant" win games.
3. Accumulated "bonus" points.
4. "In person" requirement for prize collection.
5. General tote board display of drawing results that permits players to continue playing regular casino games, while tracking drawing results. This parallel gambling system intensifies the action for a casino player.
6. Regular hourly/periodic expiration of prize collection time. Thus a player who leaves the casino and comes back after the collection period, forfeits his prize. This feature penalizes a player for leaving the casino for any extended time period.

For the intercasino game the features are:

1. The features listed above for the intracasino game, excluding feature no. 4.
7. Minimum "play" time requirement. This is the time from ticket purchase, to leaving time or "clock out". If a player does not stay in the first casino for a certain minimum time, he is subject to standard penalties. This feature induces the player to stay and play in the casino where he purchased or was given his first drawing ticket, for a certain acceptable period.
8. Maximum "away" time, or "transition" time requirement. This is the time from leaving one casino, or "clockout" time, to arriving at another system casino, "clock in" time. If a player exceeds a certain time period in going from one system casino to another he again is subject to standard penalties. This feature induces the player to proceed directly from one system casino to another, and discourages either idle time, or visiting another non-system casino.
9. A key feature of the intercasino game is that a casino A player, who has bought a casino B ticket, can collect casino A drawing wins at casino B (i.e. not "in person").
10. Another key feature is that a casino A player, who buys a casino B ticket, now qualifies for larger or a "super" jackpot if he wins the drawing in either casino.
11. The standard penalties for not exceeding minimum play time, or exceeding maximum away time are one or more of the following:
    a. loss of bonus points
    b. loss of casino A drawing eligibility
    c. loss of casino A collection privileges at casino B
    d. loss of super jackpot payoff.

THE DRAWINGS

FIG. 1 is a front elevational view of an intracasino general gaming ticket usable with this invention;

FIGS. 2-3 are rear and front elevational views of an intracasino specific game ticket usable with this invention;

FIG. 4 is a front elevational view of an intracasino tote board usable with this invention;

FIGS. 7-8 are front and rear elevational views of an intercasino ticket usable with this invention;

FIG. 9 is a front elevational view of an intercasino tote board usable with this invention;

FIG. 12 is a flow chart of a practice of this invention; and

FIGS. 13-14 are front elevational views of tickets usable with this invention.

DETAILED DESCRIPTION

Figure 5:
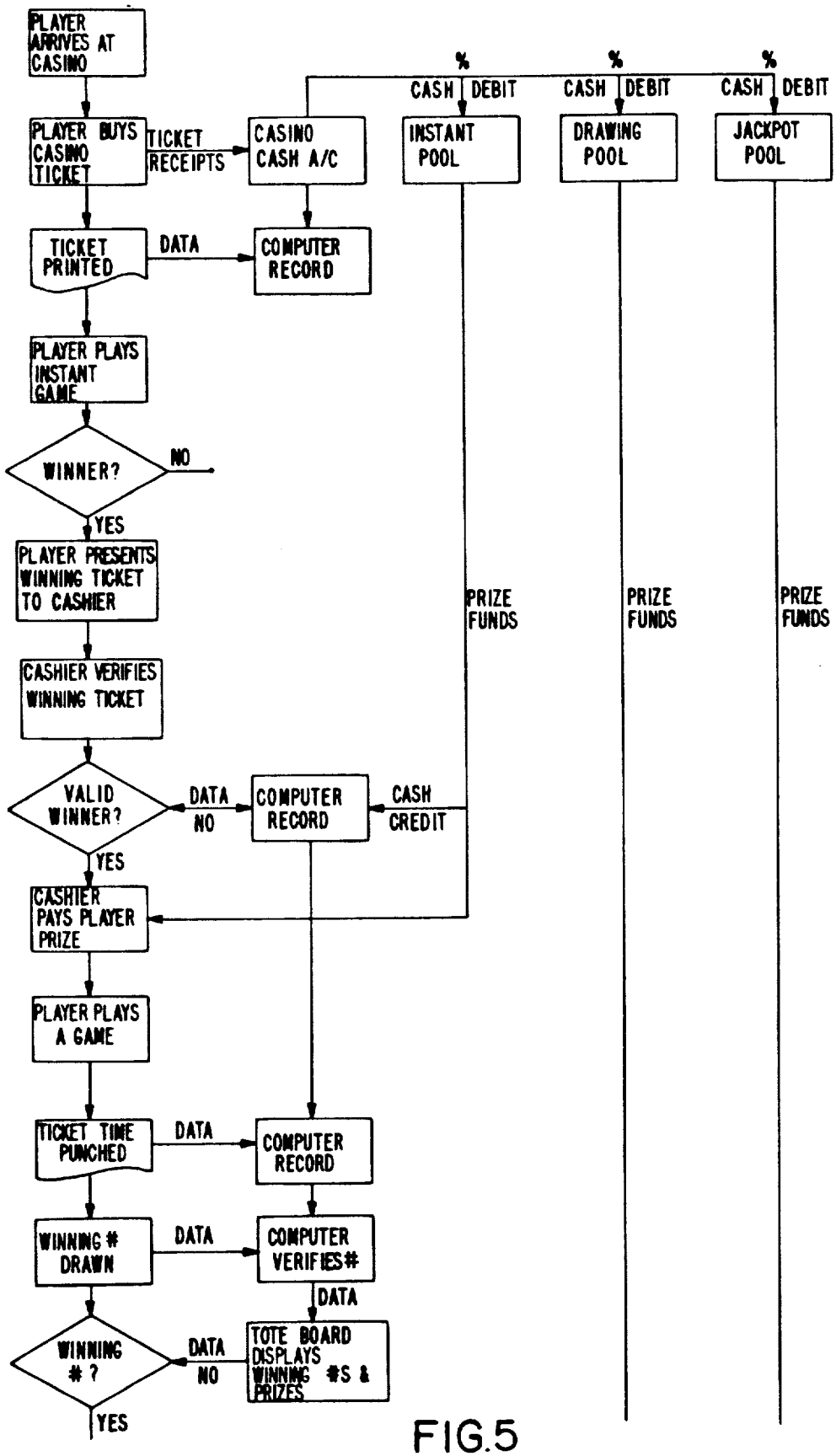
FIG. 5 is a flow chart of an intracasino game and cash management system in accordance with this invention.

The invention is directed to a promotional game which functions as a traffic builder for any business where there is a desire to attract and hold large numbers of customers (e.g. hotels, airlines, fast food and retail chains).

It is particularly suited for gaming establishments such as casinos, horsetracks, etc. The game can have one or more of the following features:

1. The game can be played using numbers, words, letters, symbols, or a combination of these.
2. A player purchases or is given a ticket or card.
3. The ticket/card can have one or more preprinted numbers that the player circles or marks, or there can be blank spaces for the player to write in the selections.
4. The card can also record other data such as:
   a. time of purchase/receipt
   b. player/holder name, address, telephone number.
5. The card can have rub/off, matching, instant win type spaces on the back or on the front. Instant wins help to build constant action into the game thus creating an atmosphere of excitement.
6. The card can be combined with other establishment or activity tickets, such as parking, flight, meal, baggage, lodging, coupons or be given separately.
7. A player writes his name, address, telephone number and circles or writes in the selections on a card.
8. The numbers can be one or more digits, and there can be one or more on a card.
9. A player can be required to be present in the establishment for a certain minimum time, or do certain things, before he qualifies/or "activates" the card.
10. A player can win if he:
    a. picks one or more numbers in a given drawing and/or
    b. picks one or more numbers in a succession of drawings (cumulative)
11. A game can payoff every drawing or not.
12. There may be a requirement that a player must be physically present, and present his I.D. to collect his winnings.
13. A player must collect his prize within a given time period.
14. Prizes can take any form.
15. A player can place one or more wagers on a card, or not.
16. Winning numbers are displayed on tote/tally boards.
17. Tote/tally boards can be restricted to certain locations in the establishment (such as the casino floor) or dispersed throughout.

The invention may be practiced where there is an instant winner, in for example every tenth drawing. For the other nine drawings a minimum number of wins would be needed to qualify for certain prizes. Larger prizes would be awarded for greater number of wins.

FIGS. 13-14 illustrate alternative ticket formats usable with this invention.

In a preferred form, the promotional game is used in a casino and can be described as having similarities to keno but no cash bets are wagered. The player arrives at the casino, and receives a prenumbered card, which can be duplicated by a perforated/tear off section, or a carbon. The card has a set of numbers printed on it. The card can also have a rub/scratch off "instant win" matching game on the back. Normally, a player can play only one card at a time, per game period. The card is good for a certain period of time, and can be time punched. The player fills out his name, address and telephone number, and leaves one copy at the game booth, which is located on the casino floor.

The winning numbers are displayed/posted on tote/tally boards throughout the casino floor area, but not in other areas of the casino. The player circles or checks ("scores") numbers on his card that must match the numbers displayed on the tote board. A version of this game could be played similar to Bingo, where the location of the numbers on the card could be necessary to win. Periodically, preferably in 10 or 15 minute intervals, a new set of numbers is flashed on the tote board. If the player is not physically present to observe the numbers, he misses a chance to "score". Certain matched numbers can result in immediate prizes, to heighten game excitement. But the main requirement is that the player must match a certain minimum number of numbers, before he wins. Once a player reaches or exceeds the minimum, he personally presents the card to the game booth where it is validated, and his identity confirmed, and he physically collects the prize. Prizes can be cash, cars, hotel rooms, jewelry or take any form. The card can then be retired, and the player issued a new card. Or the player can keep playing the same card, and win other prizes as additional numbers are matched. In the preferred form, the player retains the card and thus has a strong incentive to keep playing since he has already reached the required win minimum.

If he decides to leave Casino A, certain penalties and incentives encourage him to go quickly to another cooperating casino (Casino B).

The penalties can be:

a. invalidate Casino A card, or lose minimum;
b. lose greater prize/jackpot (progressive feature) at Casino B.

The incentives can be that the playing game/card at a member casino (i.e. B) qualifies for prize jackpot progressive feature) at Casino B.

Thus the promotional game thereby accomplishes the following desired traffic building results:

1. Attract large numbers of players to a specific establishment.
2. Attracts large numbers of players to a specific spot (casino floor) of the establishment.
3. Keeps players at the establishment, at a specific spot in a high state of activities by means of
   a. the tote board placement
   b. frequent draws
   c. in person prize collection
   d. minimum numbers for win requirement.
4. Discourages leaving due to cumulative investment in game, and penalties for leaving.

The present invention is particularly directed to enhancing conventional casino activities such as craps, slot machines, blackjack and other forms of card and table games of chance. This is accomplished by encouraging the player to remain at that casino and continue playing or to patronize only casinos in a participating group. The reward to the player is the ability to qualify for bonus prizes.

The game of this invention can be practiced in the inter or intra forms through the combinations of the following distinct elements or features:

1. A ticket(s), card or record of a gamblers casino activity.
2. A ticket, card or record for a drawing, keno or bingo type lottery or raffle.

3. A ticket, card or record that is either given to, purchased by, or maintained by computer/log on a player.
4. A drawing ticket that features one or more instant-/peel/rub off prize sections, valid in a particular casino.
5. A feature that certain rub off prize sections are valid only when a player has moved to another system casino.
6. A system/game that features a general game ticket.
7. A system/game that features a specific game ticket that has a "clock in" requirement, and can be used to control a casino-gaming mix.
8. A drawing ticket that records the following player data:
   a. Player name
   b. Ticket number
   c. Drawing number(s)
   d. System casino name
   e. Casino game
   f. Purchase time
   g. Play time
   h. Average bet
   i. Purchase date
   j. Instant/Rub/Scratch/Peel Off prize section
   k. Time of leaving ("clock out" time).
9. The feature where a player can buy only one ticket, or preferably more than one ticket.
10. The feature of periodic drawings and prizes, picked by individuals or by computer.
11. Periodic drawing prizes consisting of regular, jackpot or super jackpot prizes.
12. Prizes, jackpots and super jackpots consisting of, but not limited to, one or more of the following:
   a. cash and coins
   b. credit lines
   c. tokens
   d. meals
   e. lodging
   f. transportation
   g. cards
   h. jewelry
   i. vacations
   j. entertainment tickets
   k. sporting event tickets
   l. star/celebrity dinners
   m. drawing tickets
   n. chips
   o. lottery tickets
   p. keno or bingo type cards
   q. instant win tickets.
13. A requirement that drawing winners be physically present to collect their prize.
14. A requirement that drawing prizes must be collected within a certain time limit.
15. A requirement that players qualify for drawings by:
   a. playing one or more types of games
   b. no play requirement.
16. A requirement that players qualify for drawings by:
   a. playing for a minimum time period
   b. no time requirement.
17. A system where if a player wins a drawing, his ticket is void, and he must buy a new ticket.
18. A system where a player can win more than one drawing on the same ticket.
19. A game where a player can buy different priced tickets, qualifying for larger or different types of prizes.
20. The feature of multi sided tote boards around the casino floor, that publish the winning drawing numbers, permitting players to keep track of drawing results, without interrupting their normal gaming activity.
21. A game where drawing prizes are of equal or varying amounts.
22. A game where there are more than one winner/-prize per drawing.
23. A system/game where there is no surplus profit.
24. A system/game where there is a surplus profit.
25. A game where players qualify for drawings, and progressively larger prizes, by playing in more than one system casino, within a certain period of time.
26. A feature that requires a player play a certain minimum time in one casino before moving to another system casino.
27. A feature that players lose eligibility for drawings in one casino, when they leave and go to another.
28. A feature that players continue to be eligible for drawings in a casino, despite having left it, and having gone to another system casino.
29. The game where a player can win a drawing in one casino, while playing in another system casino.
30. The game where a player must return to the casino to collect his prize in person.
31. The game where a player can collect his prize in one casino, "in absentia" at another casino.
32. Tote boards that publish the results of winning drawing numbers, for more than one game system casino, all on the same tote board. This allows players to track their prize wins at one system casino, while they are playing at another system casino.
33. The feature that there is always a winner for every number picked in a drawing.
34. The feature that there may not be a winner for every number picked in a drawing.
35. The feature that a player loses his eligibility (voids his ticket), if he plays in a non-system casino.
36. A feature where a player loses his eligibility if too long a period passes, in moving from one casino to another.
37. A feature where if too long a time passes (transition time) in going from one system casino to another a player loses the superjackpot payoff.
38. The feature of progressively larger drawing prizes or game payoffs, based on
   a. number of games played
   b. play time
   c. average bet size
   d. number of casinos played.
39. The feature that a drawing pool must reach a certain size before the drawing is conducted, otherwise players may redeem their tickets.
40. The feature that a player must buy a ticket for every casino/gambling establishment that he enters/plays in.
41. The feature that player must play a minimum amount of time in one casino before being eligible to purchase a ticket in another system casino.
42. A game where an incentive exists, that a player qualifies for progressively larger prizes, drawings, wins, payoffs and super jackpots, when he plays at one system casino, and then plays in another system casino.

43. The feature that a player must "clock out" or record the time of his leaving one casino, before he enters/plays "clocks in" and purchases a ticket in a second system casino.

43A. See inducement/penalty features.

44. A feature where the longer a player plays, or the longer the time period from time of ticket purchase ("ticket age"), the larger a drawing prize will be. This can be accomplished by the awarding of bonus points for time that passes. This feature makes a drawing ticket have progressively more drawing win potential, even though the player has not won a drawing. This increases the incentive for the player to stay and play in the casino in the hope of a drawing prize, plus accrued bonus points.

45. An intercasino system where an incentive exists that if a player holds a ticket, and leaves "clocks out", and enters "clocks in" to another system casino, within a given time period, he can:
   a. buy another drawing ticket and qualify for drawings, prizes, jackpots in the second casino;
   b. qualify for prizes, drawings, etc. in the second casino;
   c. maintain his eligibility to return to the first casino, and collect in person drawing prizes;
   d. maintain his eligibility to collect prior casino drawing prizes (posted on the tote boards of the second casino), and that he can collect them in the second casino in person, without having to return to the first casino.

The Intercasino game is the preferred embodiment of the invention. In this form, two or more casinos, preferably in the same city, form a cooperative game structure. This game features the regular prize and jackpot drawings in each participating casino. In addition, a player can qualify for even larger drawing/jackpot prizes super jackpots if he wins it and purchases a ticket (clocks into) another system casino, preferably within a given time period, after leaving (clocking out) of the first casino. However, a player must play a certain minimum time at Casino A, before he leaves for Casino B. If he does not play for a minimum time, he can be penalized by: losing bonus points, voiding ticket A, or losing the larger prize feature in Casino B. In this way, strong incentives (drawings, jackpots and bonus points, and minimum play time) exist to attract and hold a player to a casino. Should he decide to leave, even stronger incentives exist for him to change to another casino in the cooperative game system. These incentives include drawings, jackpots, bonus points and superjackpots which would not be awarded in a non-system casino that does not have such prizes. In addition, there is the feature of voiding Casino A ticket, loss of bonus points, or loss of super jackpot, can be tied to too long a time passing going from Casino A to Casino B (transition time). Thus time out of the participating casinos is reduced. There can also be the attraction that system casino tote/display boards report on each others drawing results, so that a player can keep track of his preceding action, only if he goes to another system casino. In addition, the invention includes the feature that the player can collect his prize in absentia, at Casino B, without returning to Casino A. Thus, a group of casinos acting in concert, create a game that can better attract and hold players than other non-system casinos. Even when players leave one casino, built in reciprocal incentives and penalties cause them to proceed directly to another system casino. Thus player business is exchanged, rather than being lost to nonparticipating casinos.

In the use of this invention as an intracasino drawing game, one casino has exclusive use of the system to compete against all other casinos in a city.

A ticket(s), card or record is purchased/given to record a players daily activity, and to qualify him for prize drawings. There are two basic types of tickets: a.) general gaming ticket and b.) specific game(s) ticket.

FIG. 1 illustrates a general gaming ticket 10 which qualifies the player for drawing prizes, while playing any game in the casino.

FIGS. 2-3 illustrate the rear and front views of an intracasino specific game ticket 12 usable with this invention. Ticket 12 would qualify a player for drawings if he "clocks in" (plays) certain games listed/printed on the ticket. In this way, the casino can use this ticket to influence/control the game mix and house odds.

FIG. 4 illustrates an intracasino tote board 14 usable with this invention. Tote board 14 would be mounted on or near the ceiling so as to be readily visible to a player without interrupting the player. Tote board 14 would have the following characteristics. The four illustrations may be on separate panels of a revolving board or may all be on the same side.

1. Tote board 14 has a display panel on one or more sides, so that results can seen from different directions.
2. Tote boards 14 are dispersed throughout the entire casino floor area, so that all players can keep track of drawing results without interrupting gaming play.
3. Tote boards 14 are preferably computerized animated and have video features for the instant and live reporting of prizes, award winners and drawings.
4. Tote boards 14 have spaces for displaying:
   a. the time in hours, minutes and seconds
   b. the winning numbers
   c. the winner's name
   d. the prize or amount won
   e. prize collection deadline (expiration time).

Figure 6:
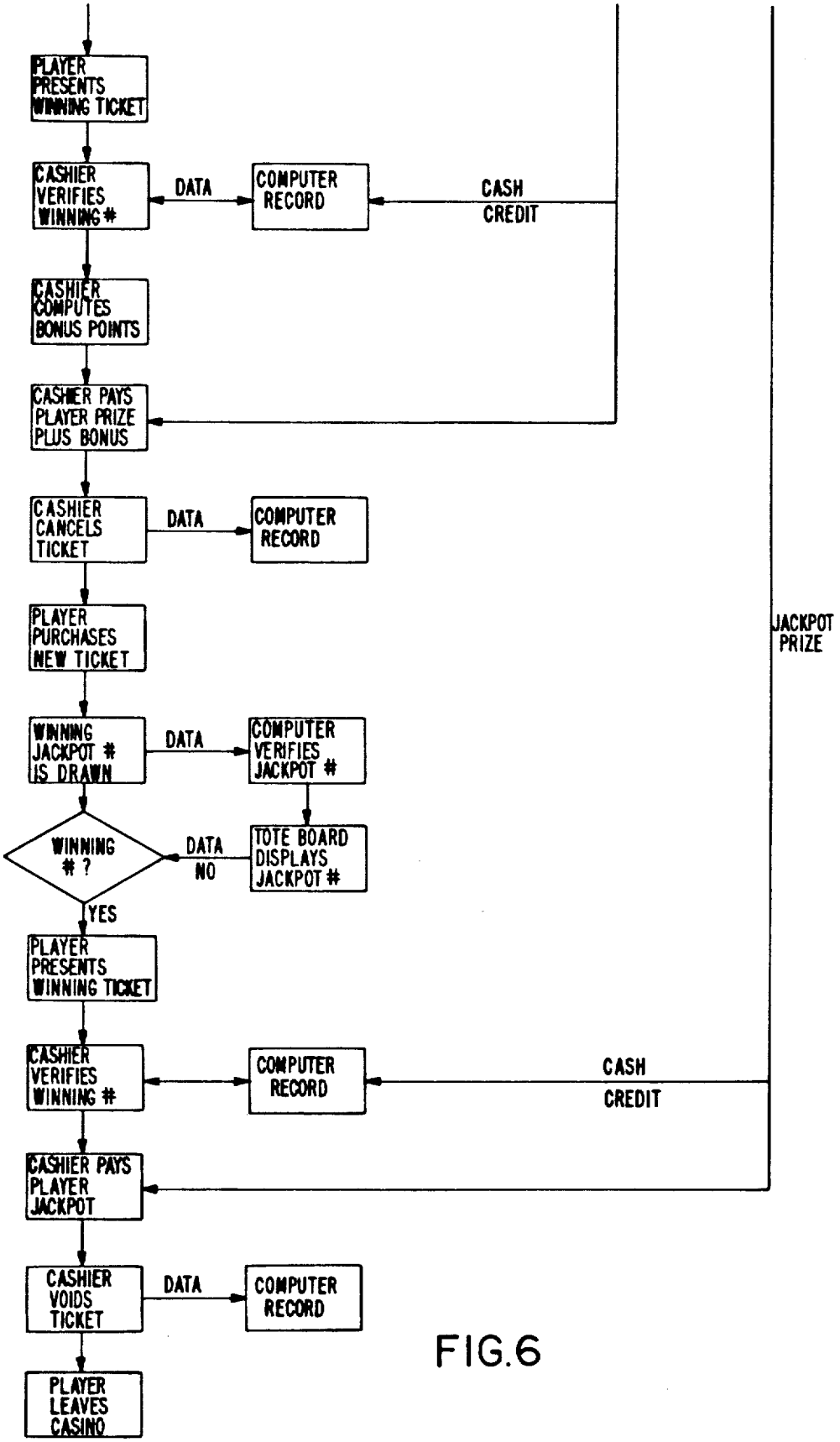
FIG. 6 is a continuation of the flow chart of FIG. 5.

FIGS. 5-6 illustrate an intracasino came and cash management system flowchart which involves the following steps.

1. Player arrives at Casino A;
2. Player buys or receives a specific or general game ticket 10 or 12;
3. Ticket purchase time is stamped;
4. "X" mark printed for each game purchased;
5. Record of ticket is entered into computer record;
6. Ticket funds/prizes are allocated to each purchased game drawing pool, or to one general drawing pool;
7. Ticket funds/prizes allocated to jackpot pool;
8. Ticket funds/prizes allocated to instant win/rub off prizes;
9. Player scratches/peels off instant win section, and wins or loses;
10. Player presents instant win to cashier for prize;
11. Cashier verifies ticket;
12. Cashier pays prize;
13. Instant pool cash is credited;
14. Player plays a game;
15. Player has ticket time punched to record play;

16. Computer or players draw winning numbers hourly, and jackpots periodically;
17. Tote boards 14 display winning numbers, winners, prizes and time;
18. Player presents winning ticket number to cashier;
19. Cashier verifies winning ticket;
20. Cashier computes elapsed time since purchase for bonus prize;
21. Cashier pays player winning prize amount, plus bonus;
22. Drawing pool cash is credit;
23. Cashier cancels/voids ticket, which is good for one prize;
24. Player buys a new ticket;
25. Player leaves Casino A;
26. Drawings occur, but player cannot collect prize unless he returns in person, and before drawing time period expires;
27. Player returns to collect prize in person.

FIGS. 7–8 illustrate an intercasino ticket 16 which is similar to the intracasino ticket 12, with the addition of:

1. clock out time
2. clock in time
3. a space identifying other system casinos.

An intercasino ticket could also be printed that was a "master ticket", so that a separate ticket would not be required when entering another system casino, but that a purchase space would be punched, and drawing number printed, on the original ticket.

FIG. 9 illustrates an intercasino tote board 18 which is similar to the Intracasino tote board 14, but can post the same display for more than one casino. This permits a player in one casino to track the results in another.

Figure 10:
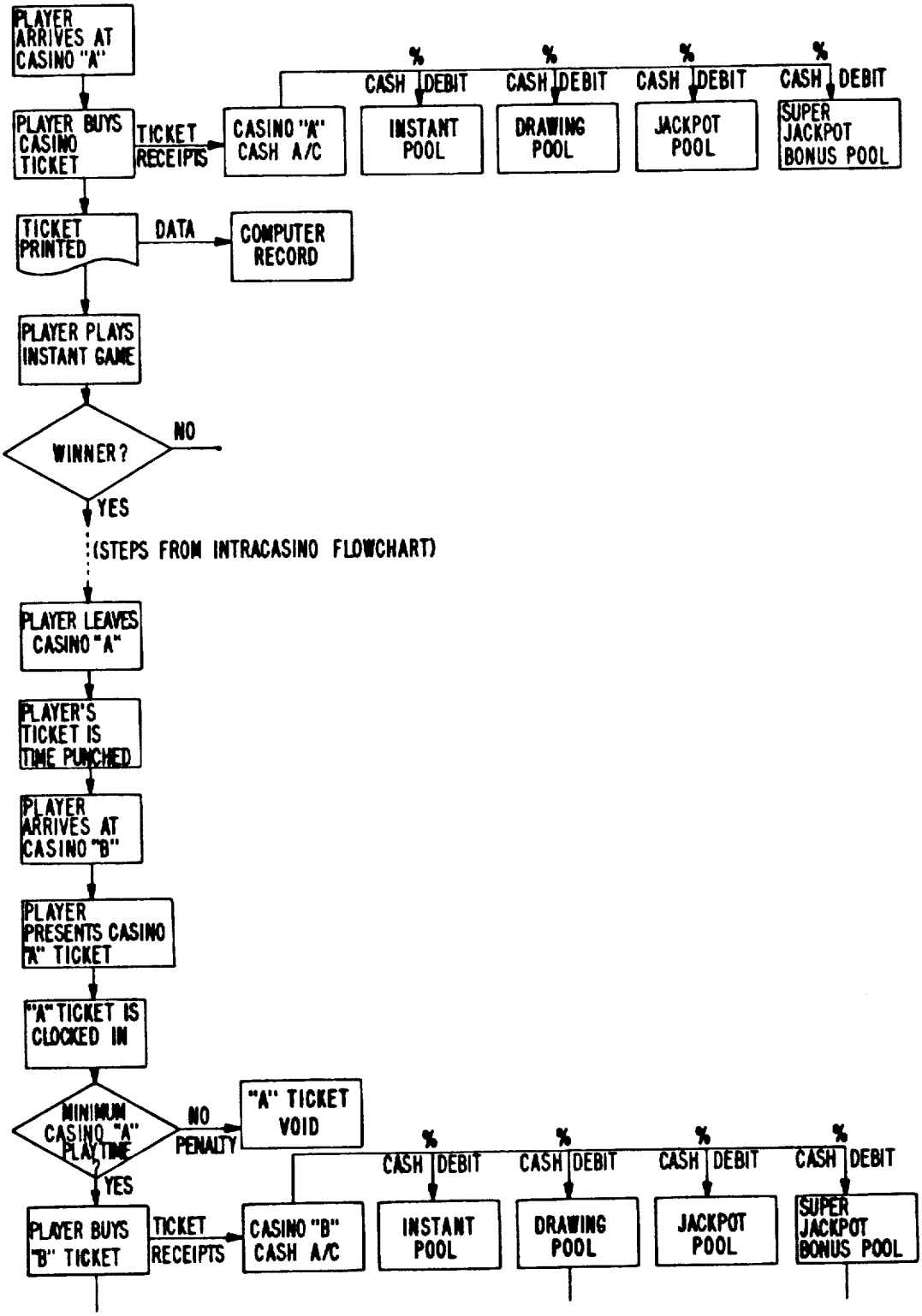
FIG. 10 is a flow chart of an intercasino game and cash management system in accordance with this invention.
Figure 11:
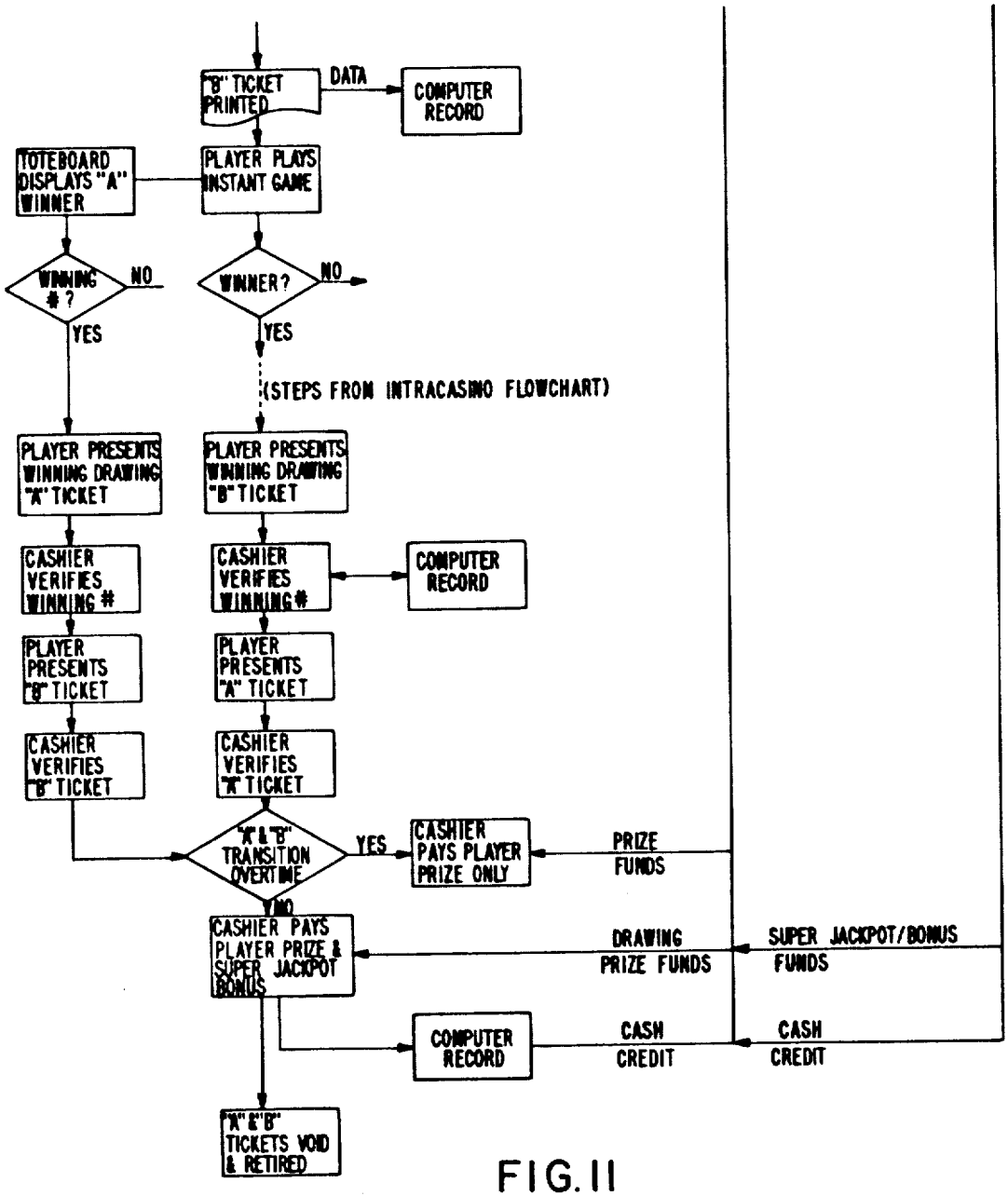
FIG. 11 is a continuation of the flow chart of FIG. 10.

FIGS. 10–11 illustrate an intercasino game flowchart which involves the following steps.

1. Player purchases a Casino A ticket, and plays the minimum required time.
2. Player leaves Casino A, and "A" ticket is time punched (clocked out).
3. Player arrives at Casino B, from Casino A.
4. Player presents ticket A to ticket office of Casino B.
5. Players minimum play time is verified. [* If player does not play the minimum time in Casino A, he can lose A bonus points, drawing eligibility or superjackpot at Casino B.]
6. Players "A" ticket is time punched (clocked in).
7. Player buys/receives a "B" ticket for a specific game(s), or a general (all games) ticket. [** One ticket can have all system casinos listed on it, and the ticket is punched (activated) as a player buys his way into a casino.]
8. Money is allocated to drawing pools (i.e. instant, drawing, jackpot and superjackpot).
9. Steps 9–19 (Intracasino system)
10. Cashier verifies no transition "overtime". [*** If a player exceeds transition time from Casino A to Casino B, he can lose Casino A drawings, and/or Casino B bonus points, or super jackpot.]
11. Cashier pays player drawing prize, and super jackpot.
12. Drawing pool and superjackpot pool is credited.
13. Winning ticket is canceled/retired.
14. Player buys a new ticket.

FIG. 12 is a diagram of the player incentive or penalty aspects of the inter or intracasino game. The incentive aspects would include bonus points or eligibility for a jackpot when the player is at a casino in excess of the minimum time. There would be a penalty, such a loss of points if the player stays less than a minimum time or exceeds the allowed transition time to travel to a different participating casino. If a player is not clocked in to a member casino when Casino A draws the winning jackpot number, the player does not qualify to win.

What is claimed is:

1. A process for playing a lottery or drawing keno/-bingo type game for increasing participation in casino games of chance comprising the steps of issuing a ticket or card to a player at a casino, recording on the ticket the participation of the player in a casino activity, entering the player as qualifying for a lottery drawing when a preselected minimum of activity participation in said casino activity is attained by the player, conducting a lottery from qualified players, and awarding a prize to the lottery winner.

2. The process of claim 1 including awarding bonus points to the player when different levels of activity participation are obtained to increase the chances of the player being awarded a prize.

3. The process of claim 2 including penalizing the player by loss of at least some bonus points when a prohibited activity is performed.

4. The process of claim 1 including limiting the activity participation to a single casino.

5. The process of claim 3 including requiring the player to be present to be awarded the prize.

6. The process of claim 1 including requiring a minimum play time as the activity participation.

7. The process of claim 1 wherein the ticket is in the form of a computer record maintained by the casino.

8. The process of claim 1 wherein the activity participation is participation in preselected casino games of chance.

9. The process of claim 1 wherein the activity participation is a minimum monetary level of participation in casino games of chance.

10. The process of claim 1 including conducting the lottery or keno/bingo type drawing at periodic time intervals.

11. The process of claim 10 including providing instant win match areas on the ticket or card.

12. The process of claim 10 including displaying the lottery results on an elevated tote board.

13. The process of claim 1 including limiting the activity participation to a group of preselected casinos.

14. The process of claim 13 including penalizing the player when a preselected travel time allowance is exceeded.

15. The process of claim 13 including issuing a separate ticket or card to the player for every casino entered.

16. A method of playing a lottery or keno/bingo drawing type promotional game to encourage players to remain in a given location comprising the steps of issuing a ticket to each of a plurality of players, each player indicating personal identification data on his ticket, each player having pre-printed or selected indicia on the ticket, a copy of the ticket being retained by the conductor of the game, providing instant win sections on the ticket, each player checking if there is an instant win, the conductor periodically drawing indicia in multiple time periods within a day and having the drawn indicia displayed on a tote board for simultaneous viewing by the plurality of players, the player comparing the drawn indicia with the selected indicia, and awarding a prize when a preselected drawn indicia from any of the drawings and ticket selected indicia are matched.

17. The method of claim 16 wherein the playing ticket is combined with an activity ticket.

18. The method of claim 16 wherein the player must be personally present to collect the prize within a given time period.

19. The method of claim 16 wherein the indicia is selected by the player before the conductor retains a copy of the ticket.

20. The method of claim 16 wherein the indicia is selected by being preprinted on the ticket.

21. The method of claim 16 wherein the same ticket is used for matching indicia from a plurality of periodic drawings.

22. The method of claim 21 wherein a super prize is awarded by matching a larger number of indicia than the preselected number which qualifies for the original prize.

23. A method for playing a lottery or drawing keno/-bingo game for increasing participation in casion games of chance comprising the steps of issuing a ticket to each of a plurality of players upon entering the casino, providing a concealed instant win section on the ticket, providing personal indicia on each ticket distinct for that ticket, the player exposing the concealed instant win section and being awarded a prize when the instant win section so qualifies, a conductor in the casino periodically conducting a drawing of indicia in multiple time periods within a day to draw winning indicia, displaying the winning indicia on a tote board visible to the plurality of players, and awarding a prize to players having personal indicia matching the winning indicia of any drawing.

24. The method of claim 23 wherein the ticket is a parking ticket.

25. A method for playing a lottery or drawing keno/-bingo game for increasing participation in casino games of chance comprising the steps of issuing a parking ticket to each of a plurality of players upon entering the parking lot of a casino, providing personal indicia on each parking ticket distinct for that ticket, a conductor in the casino periodically conducting a drawing of indicia in multiple time periods within a day to draw winning indicia, displaying the winning indicia on a tote board visible to the plurality of players, and awarding a prize to players having personal indicia matching the winning indicia of any drawing.

* * * * *

UNITED STATES PATENT AND TRADEMARK OFFICE

CERTIFICATE OF CORRECTION

PATENT NO. : 5,129,652

DATED : July 14, 1992

INVENTOR(S) : William T. Wilkinson

It is certified that error appears in the above-indentified patent and that said Letters Patent is hereby corrected as shown below:

On the title page, ite, [54], & Col. 1, line 2, the title should read --CASINO DRAWING/LOTTERY GAME AND CASH/PRIZE MANAGEMENT SYSTEM--.

Signed and Sealed this

Sixteenth Day of May, 1995

*Attest:*

Bruce Lehman

BRUCE LEHMAN

*Attesting Officer*

*Commissioner of Patents and Trademarks*